US007042409B2

(12) United States Patent
Desargant et al.

(10) Patent No.: US 7,042,409 B2
(45) Date of Patent: May 9, 2006

(54) METHOD AND APPARATUS FOR MOUNTING A ROTATING REFLECTOR ANTENNA TO MINIMIZE SWEPT ARC

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 23 days.

(21) Appl. No.: 10/859,486

(22) Filed: Jun. 2, 2004

(65) Prior Publication Data

US 2004/0222933 A1 Nov. 11, 2004

Related U.S. Application Data

(63) Continuation-in-part of application No. 09/965,668, filed on Sep. 27, 2001, now Pat. No. 6,861,994.

(51) Int. Cl.
*H01Q 3/00* (2006.01)

(52) U.S. Cl. ..... 343/765; 343/757

(58) Field of Classification Search ..... 343/765, 343/781 R, 757
See application file for complete search history.

(56) References Cited

U.S. PATENT DOCUMENTS

| | | | | |
|---|---|---|---|---|
| 2,421,593 A | | 6/1947 | Bishop | 343/761 |
| 2,427,005 A | | 9/1947 | King | 343/762 |
| 3,845,483 A | * | 10/1974 | Soma et al. | 343/761 |
| 3,860,930 A | | 1/1975 | Peterson | 343/705 |
| 3,938,162 A | * | 2/1976 | Schmidt | 343/840 |
| 5,351,060 A | * | 9/1994 | Bayne | 343/766 |
| 5,835,057 A | | 11/1998 | van Heyningen | 342/359 |
| 6,061,033 A | * | 5/2000 | Hulderman et al. | 343/781 CA |
| 6,542,129 B1 | * | 4/2003 | Bien et al. | 343/766 |
| 6,861,994 B1 | * | 3/2005 | Desargant et al. | 343/765 |
| 6,919,852 B1 | * | 7/2005 | Desargant et al. | 343/766 |

OTHER PUBLICATIONS

A Satellite-Tracking K- and Ka-Band Mobile Vehicle Antenna System dated Nov. 1993, Authors Arthur C. Densmore and Vahraz Jamnejad, 9 pages.
International Search Report for PCT/US 02/ 28740, 4 pages.

* cited by examiner

*Primary Examiner*—Tho Phan
(74) *Attorney, Agent, or Firm*—Harness Dickey & Pierce P.L.C.

(57) ABSTRACT

An apparatus and method for mounting a rotatable reflector antenna system on an outer surface of an aircraft which minimizes a swept arc of a main reflector. This allows the effective frontal area of the main reflector to be reduced such that a radome with a smaller frontal area can be employed to cover the antenna system. The main reflector is rotated about an azimuth axis which is disposed forward of an axial center (i.e., vertex) of the main reflector. In one embodiment the azimuth axis is located in a plane extending between the outermost lateral edges of the main reflector, which define the aperture of the antenna. In another embodiment the azimuth axis is located forward of the outermost lateral edges of the main reflector. In further embodiments the azimuth axis of rotation is located in between a subreflector and a feed horn of the antenna, or in between the vertex of the main reflector and the subreflector.

27 Claims, 4 Drawing Sheets

FIG 1
PRIOR ART
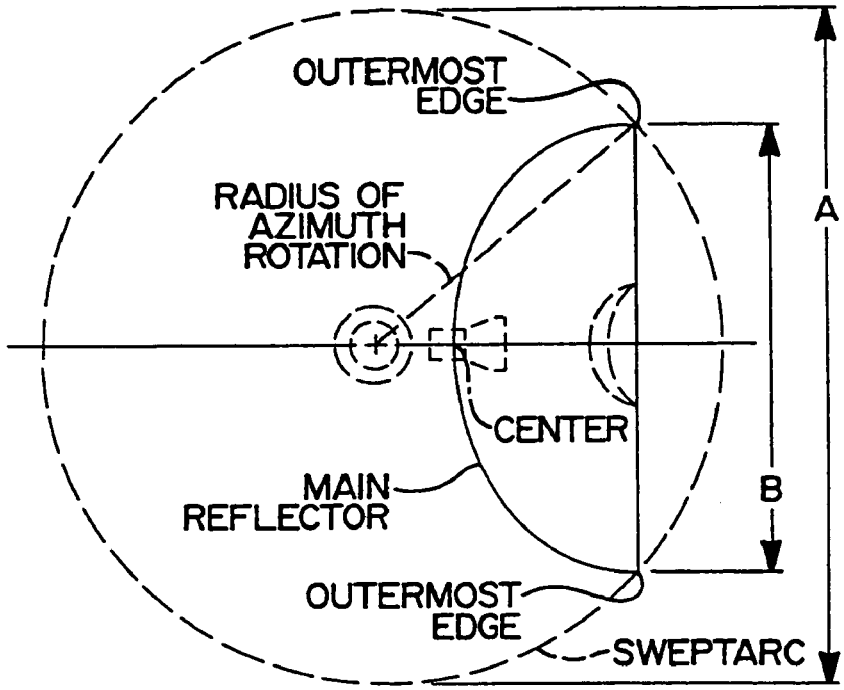
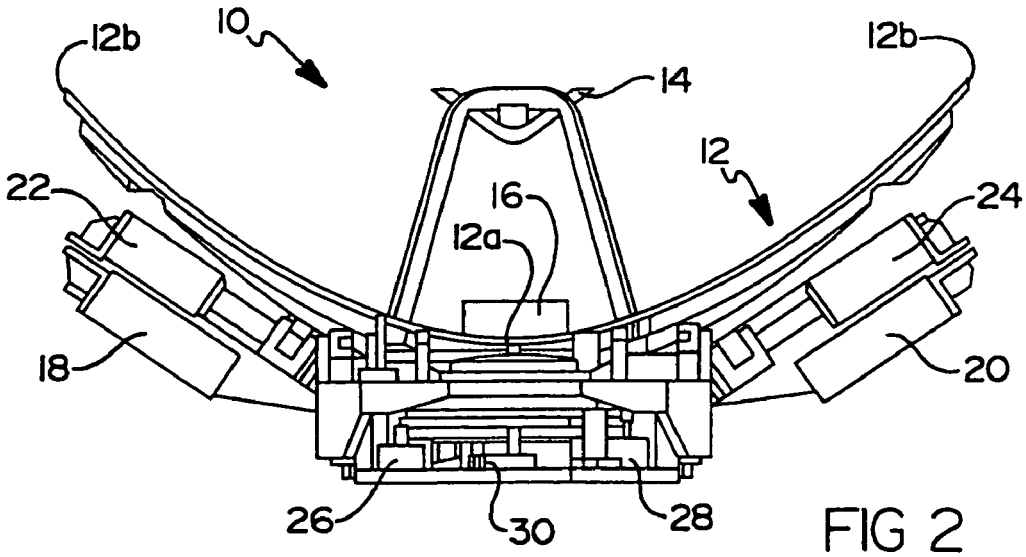
FIG 2
PRIOR ART

FIG 5
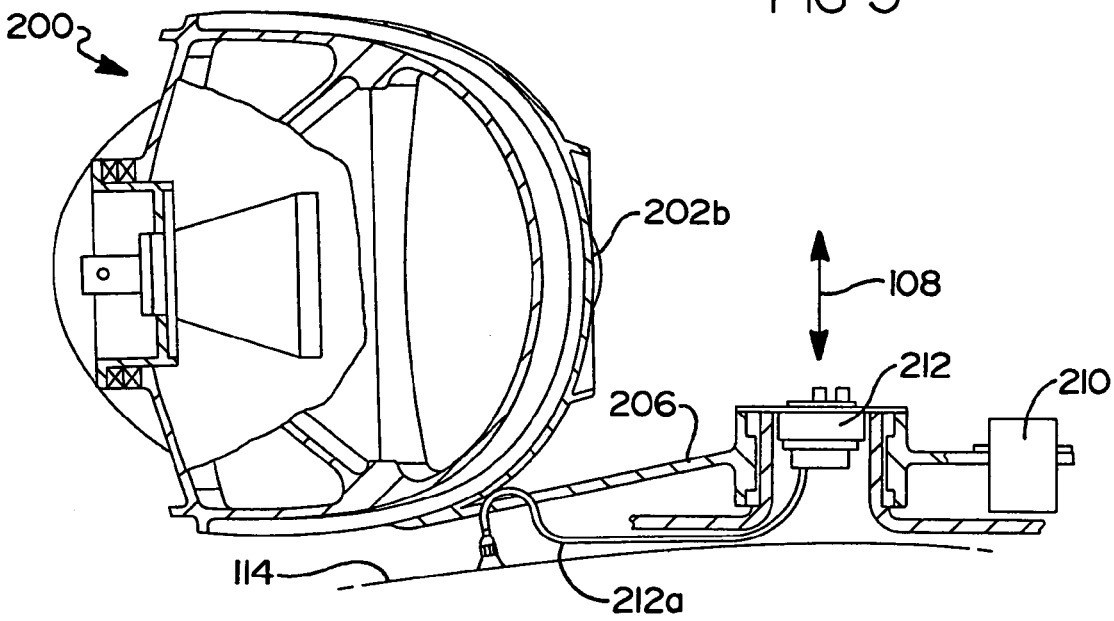
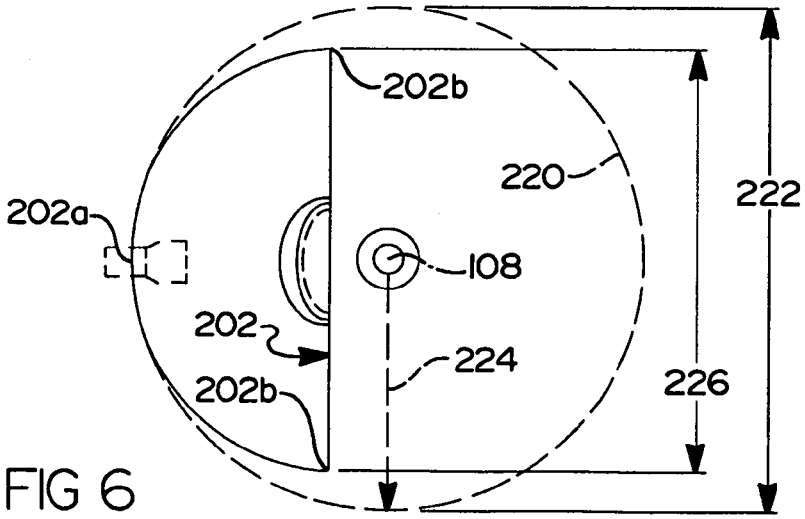
FIG 6

FIG 7
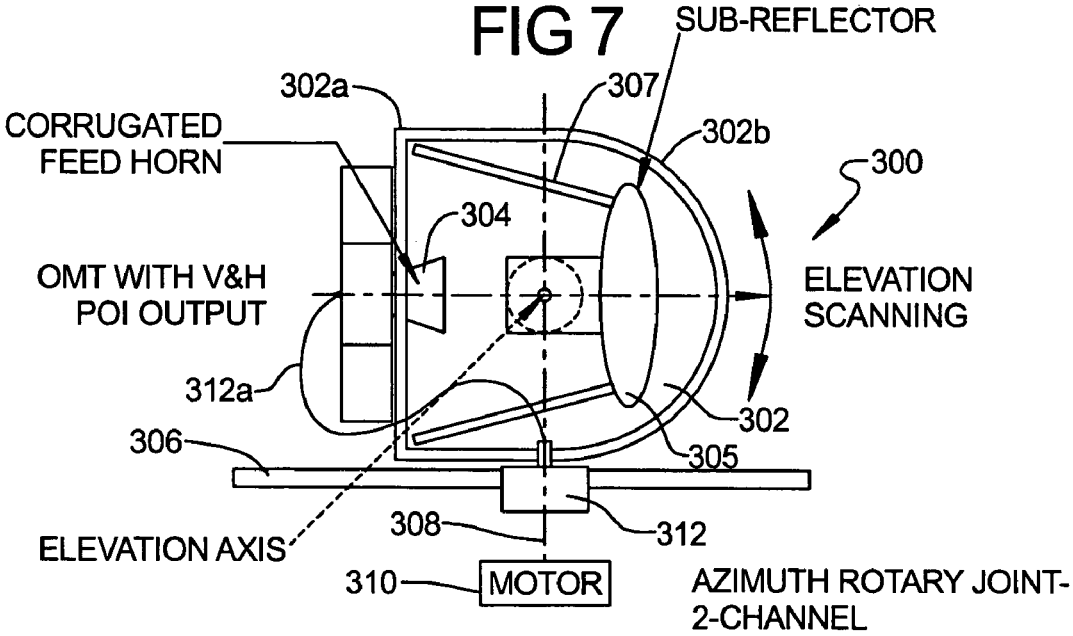
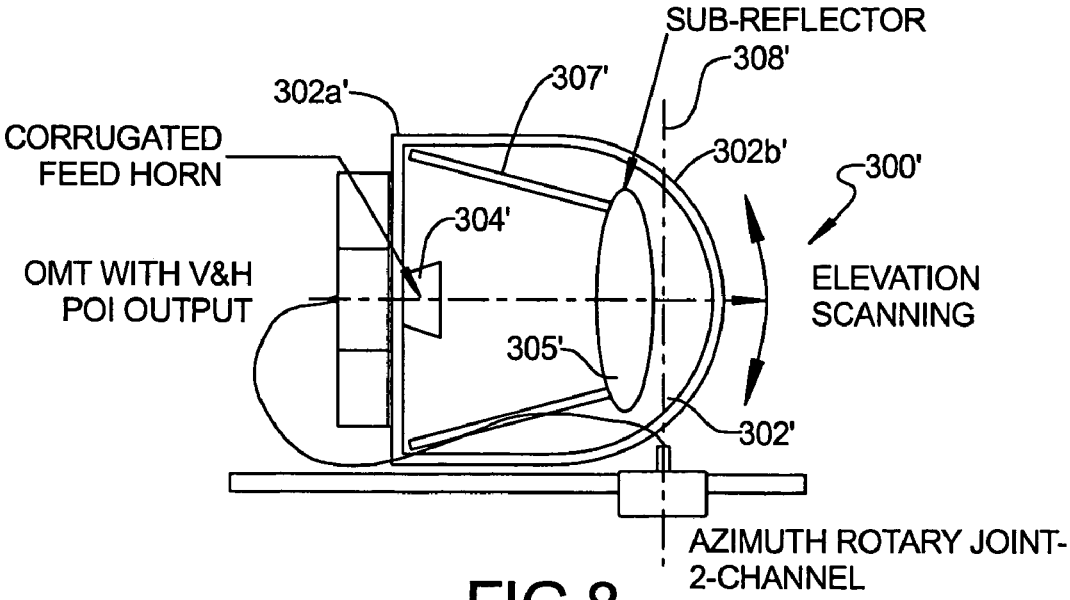
FIG 8

METHOD AND APPARATUS FOR MOUNTING A ROTATING REFLECTOR ANTENNA TO MINIMIZE SWEPT ARC

CROSS REFERENCE TO RELATED APPLICATION

This application is a continuation-in-part of U.S. patent application Ser. No. 09/965,668, filed Sep. 27, 2001 now U.S. Pat. No. 6,861,994. The disclosure of the above application is incorporated herein by reference.

FIELD OF THE INVENTION

The present system relates to antenna systems, and more particularly to a method and apparatus for mounting a reflector antenna in such a manner as to minimize the swept arc of the antenna when the antenna is rotated about its azimuth axis.

BACKGROUND OF THE INVENTION

The frontal surface area of an antenna mounted on an aircraft, under a radome, is of critical importance with respect to the aerodynamics of the aircraft. This is because of the drag created by the radome and the resulting effects on aircraft performance and fuel consumption. With reflector antennas that must be rotated about their azimuth axes, the "swept arc" of the antenna is larger than the overall width of the main reflector of the antenna. This necessitates a commensurately wide radome, thus increasing the frontal surface area of the radome and consequently increasing the drag on the aircraft.

Referring to FIG. 1, the diameter of a swept arc "A" of a main reflector of a prior art antenna system can be seen when the azimuth axis of rotation is located rearward, or behind, an axial center of the main reflector, as is conventional with present day reflector antenna systems. The outermost edges of the main reflector are also noted. This diameter is noted by dimension "B". The diameter of the swept arc produced by the main reflector is considerably larger than the diameter of the main reflector itself when the azimuth axis of rotation is located at, or rearward of, the center of the main reflector.

It is therefore extremely important that the height and width of a reflector antenna be held to the minimum dimensions consistent with the required electromagnetic performance of the antenna. More particularly, it is important for the main reflector of an antenna intended to be mounted on an outer surface of an aircraft, to be mounted in such a manner that the swept arc of the antenna is minimized when the antenna is rotated about its azimuth axis. Minimizing the swept arc of the antenna would thus minimize the dimensions of the radome required to cover the antenna, and thereby minimize the corresponding drag created by the radome while an aircraft on which the radome is mounted is in flight.

SUMMARY OF THE INVENTION

The above drawbacks are addressed by a new antenna system and a method for mounting an antenna system. The antenna system generally comprises a main reflector which is mounted on a mounting platform. The mounting platform is rotatable about an azimuth axis to allow the azimuth scanning angle of the antenna to be adjusted as needed. An azimuth motor is used for rotating the platform as needed to aim the main reflector in accordance with the desired azimuth scanning angle.

A principal feature is that the azimuth axis about which the main reflector is rotated is disposed forward of the vertex of the main reflector, rather than at, or rearward of, the vertex of the main reflector. In one preferred form the azimuth axis is located at a point within a plane bisecting the outermost edges of the main reflector. In another preferred embodiment, the azimuth axis is located forward of the outermost edges of the main reflector. With either arrangement, the swept arc of the main reflector is reduced from that which would otherwise be produced if the azimuth axis was located in a plane coincident with the vertex of the main reflector, or rearward of the vertex of the main reflector. The maximum reduction in swept arc is provided by locating the azimuth axis within the plane bisecting between the outermost ends of the main reflector.

By supporting the main reflector of the antenna at a position laterally offset (i.e., rearward) of the azimuth axis about which the mounting platform is rotated, the swept arc of the antenna is reduced significantly. This decreases the frontal surface area of a radome needed to house the antenna system when the system is mounted on an exterior surface of an aircraft. This mounting arrangement does not significantly complicate the assembly or construction of the antenna system itself or otherwise require significant modifications to the outer body surface of an aircraft on which the antenna system is to be mounted.

In still another alternative preferred embodiment, the antenna system has the azimuth axis of rotation placed between the feed horn and the subreflector. In yet another alternative preferred embodiment the antenna system has the azimuth axis of rotation placed between the vertex of the main reflector and the subreflector. Each of these embodiments reduce the swept arc of the main reflector over that which would be produced with the azimuth axis of rotation positioned rearward of the main reflector, while still providing extremely compact arrangements that are well suited for use on a high speed mobile platform, where the antenna system needs to be housed within a radome.

Further areas of applicability of the system will become apparent from the detailed description provided hereinafter. It should be understood that the detailed description and specific examples, while indicating various preferred embodiments, are intended for purposes of illustration only.

BRIEF DESCRIPTION OF THE DRAWINGS

The present system will become more fully understood from the detailed description and the accompanying drawings, wherein:

FIG. 1 is a simplified diagram of the swept arc produced by a prior art mounting arrangement wherein the azimuth axis of rotation of the main reflector is disposed slightly rearward of the center of the main reflector;

FIG. 2 is a plan view of a prior art reflector antenna;

FIG. 5 is a side view of the antenna system of the present invention located with the azimuth axis disposed in a plane located forward of the outermost edges of the main reflector of the antenna system;

FIG. 6 is a diagram of the swept arc produced by the antenna system shown in FIG. 5; and FIG. 7 illustrates a partial side cross sectional view of an alternative preferred embodiment of the antenna system in which the azimuth axis of rotation is placed in between the feed horn and the subreflector of the system; and FIG. 8 illustrates still another alternative preferred embodiment of the antenna system in which the azimuth axis of rotation is placed in between the vertex of the main reflector and the subreflector.

DETAILED DESCRIPTION OF THE PREFERRED EMBODIMENTS

Figure 3:
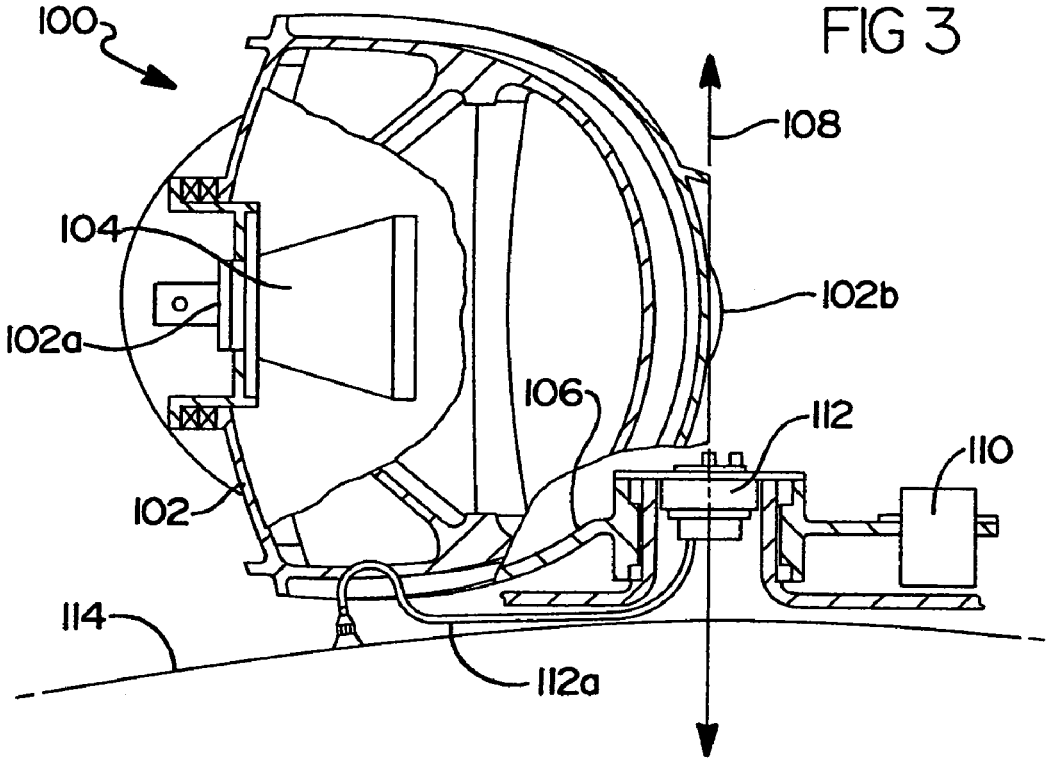
FIG. 3 is a side view of an antenna system in accordance with a preferred embodiment of the present system illustrating the azimuth axis located within a plane extending between the outermost edges of the main reflector of the antenna.

The following description of the preferred embodiment(s) is merely exemplary in nature and is in no way intended to limit the system, its application, or uses.

Referring to FIG. 2, a prior art antenna system 10 well suited to be mounted on an external surface of an aircraft is shown. The antenna system 10 includes a main reflector 12 having a center (i.e., vertex) 12*a* and outermost edge portions 12*b*. A subreflector 14 is positioned forward of a feedhorn 16 located at the center 12*a* of the main reflector 12. A pair of low noise amplifiers (LNA) 18 and 20 are used, as are a pair of diplexers 22 and 24, for performing signal conditioning operations on the received and transmitted signals. An elevation motor 26 is used to position the main reflector 12 at a desired elevation angle, while an azimuth motor 28 is used to rotate the main reflector 12 about an azimuth axis to position the main reflector at a desired azimuth angle. An encoder 30 is used to track the azimuth angle of the main reflector 12 and to provide feedback to the azimuth motor 28.

Referring now to FIG. 3, an antenna system 100 in accordance with a preferred embodiment of the present invention is illustrated. The antenna system 100 is similar to antenna system 10 by the use of a main reflector 102 having an axial center (i.e., vertex) 102*a* and outermost lateral edge portions 102*b*. A feedhorn 104 is disposed at the center 102*a* of the main reflector 102. The main reflector 102 is supported on a platform 106 which places the azimuth axis of rotation 108 of the main reflector 102 in a plane which extends through the outermost edges 102*b* of the main reflector. The platform 106 is rotated about the azimuth axis of rotation 108 by an azimuth motor 110 to thus position the main reflector 102 at a desired azimuth angle. A two channel coaxial rotary joint 112 is preferably employed to enable the necessary electrical connections between the feedhorn 104 and a transmission line 112*a* which extends through an outer surface 114 of an aircraft. For simplicity, the radome which would ordinarily enclose the entire antenna system 100 has not been shown.

Figure 4:
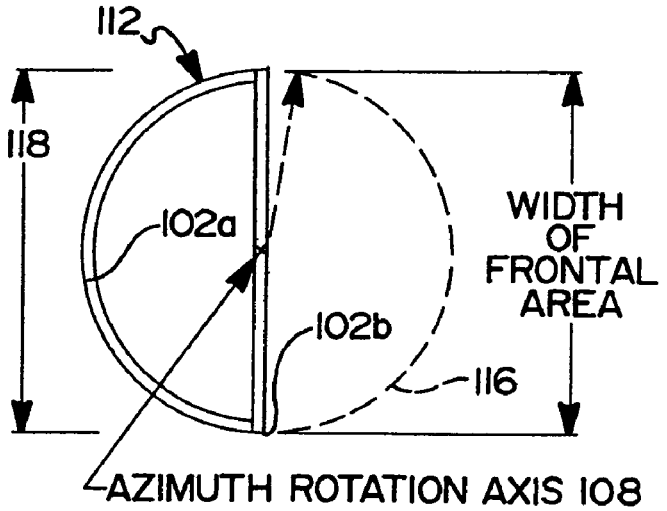
FIG. 4 is a diagram illustrating the reduced diameter of a swept arc produced by locating the azimuth axis of rotation as shown in FIG. 3.

Referring to FIG. 4, a swept arc 116 is shown which is produced by rotational movement of the main reflector 102, shown in highly simplified form, of the antenna system 100. When the azimuth axis of rotation 108 is located such that it extends through the outermost lateral edges 102*b* of the main reflector 102, as described in connection with FIG. 3, the radius of the swept arc 116 is minimized to the maximum extent. In this configuration the swept arc 116 is approximately one-half that of the overall length 118 of the reflector 102. Thus, locating the azimuth axis of rotation 108 forward of the center (i.e., vertex) 102*a* of the main reflector 102 (i.e., to the right of center point 102*a* in FIG. 3) dramatically reduces the swept arc produced by the main reflector. This reduction in the overall area, and volume, of the swept arc is also visible from a comparison of FIGS. 1 and 4.

The location of the azimuth axis of rotation of the antenna system 100 shown in FIG. 3, however, in some applications, may result in an unacceptable degree of blockage of the signal being transmitted and/or received by the antenna system 100. Accordingly, it may be desirable to locate the azimuth axis of rotation 108 shown in FIG. 3 forward of the outermost edges 102*b* of the main reflector 102. Such a mounting arrangement is shown in FIG. 5. Antenna system 200 shown in FIG. 5 is identical with antenna system 100 shown in FIG. 3 with the exception that mounting platform 206 has a longer overall length to allow the azimuth axis of rotation 108 to be located forward (i.e., to the right in FIG. 5) of the outermost edges 202*b* of the main reflector 202. It will also be appreciated that components of the antenna system 200 in common with those of antenna system 100 have been designated by reference numerals increased by a factor of 100 over those used to denote the components of the antenna system 100. The swept arc produced by the antenna system 200 is shown in FIG. 6. The swept arc is designated by dashed circle 220. The maximum, effective frontal width of the main reflector 202 is thus represented by arrow 222, which is only slightly larger than a diameter 226 of the main reflector. The radius of rotation of the reflector 202 is represented by line 224. When comparing the swept arc 220 of FIG. 6 with the swept arc 116 illustrated in FIG. 4, it can be seen that the swept arc produced by the mounting arrangement of antenna system 200 is slightly greater than that produced by antenna system 100. However, the location of the azimuth axis forward of the outermost edges 202*b* of the main reflector 202 helps to eliminate a degree of the blockage produced by the mounting platform 206 and the rotary joint 212.

Referring now to FIG. 7, an antenna 300 in accordance with another alternative preferred embodiment of the present system is shown. Antenna 300 is identical in construction to the antennas 100 and 200 and forms a Cassegrain antenna having a main reflector 302 in the shape of a dish, a feedhorn 304, a subreflector 305, and a platform 306 supporting the main reflector. The subreflector 305 is supported in front of the feedhorn 304, and from the main reflector 302, by a support structure 307. The subreflector 305 is disposed within a plane residing in between the feedhorn 304 and outermost edge 302*b* of the main reflector 302. The platform is supported for rotation in the azimuth plane about an azimuth axis of rotation 308 by a suitable motor 310. A coaxial rotary joint 312 is coupled to a transmission line 312*a*. Transmission line 312*a* may comprise a coaxial cable or any other suitable electrical conductor(s). The antenna 300 differs from antennas 100 and 200 in that the azimuth axis of rotation is disposed forward of a vertex 302*a* of the main reflector 302, but rearward of outermost edge 302*b* of the main reflector. In the embodiment shown in FIG. 7, the azimuth axis of rotation is disposed in between the subreflector 305 and the feedhorn 304. This placement of the azimuth axis 308 provides a degree of reduction in the diameter of the swept arc of the main reflector 302 over that which would be produced by locating the azimuth axis at the vertex 302*a*, but not to the same degree as locating the azimuth axis 302*a* at the outermost edge 302*b*.

FIG. 8 shows another embodiment of the antenna system 300'. The components corresponding to those of FIG. 7 are denoted with common reference numerals that also have a prime symbol. The antenna system 300' is identical in construction to the antenna system 300 with the only difference being that the azimuth axis of rotation 308' is located in a plane residing in between the outermost edge 302*b*' of the main reflector 302' and the subreflector 305'. Both of the antennas 300 and 300' reduce the swept arc beyond that of the prior art antenna shown in FIG. 1.

The preferred embodiments of the present system thus provide a means for supporting a reflector antenna in a manner which minimizes the effective frontal area of the reflector antenna, and thus allows a radome having a smaller frontal area to be employed in covering the antenna when the antenna is located on an outer surface of an aircraft. The preferred embodiments do not significantly complicate the construction of the antenna system nor do they complicate the mounting of the antenna system on the outer surface of an aircraft. Furthermore, the preferred embodiments do not significantly add to the costs of construction of the antenna systems.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for mounting a rotatable type reflector antenna having a main reflector with outermost edges and a vertex, a subreflector mounted forward of the main reflector and a feed horn mounted forward of the subreflector, to reduce a radius of a swept arc of said main reflector as said main reflector is rotated about an azimuth axis of rotation, said method comprising:

supporting said main reflector on a mounting component;

rotating said mounting component about said azimuth axis of rotation; and locating said azimuth axis of rotation in between said vertex and said outermost edges of said main reflector.

2. The method of claim 1, wherein rotating said mounting component comprises using an electric motor disposed on said mounting component.

3. The method of claim 1, further comprising using a coaxial rotary joint operably associated with said mounting component to electrically couple said feed horn to an external transmission cable.

4. A method for mounting a rotatable reflector antenna having a main reflector with outermost edges and a vertex, a subreflector mounted forward of the vertex, and a feed horn mounted at the vertex, so as to reduce a radius of a swept arc of said main reflector as said main reflector is rotated about an azimuth axis of rotation, said method comprising:

supporting said main reflector on a mounting component;

rotating said main reflector about said azimuth axis of rotation; and locating said azimuth axis of rotation in between said feed horn and said subreflector.

5. The method of claim 4, wherein supporting said main reflector comprises mounting said main reflector on a mounting platform having a rotary coaxial joint.

6. The method of claim 4, wherein rotating said main reflector comprises using an electric motor.

7. The method of claim 6, wherein using said electric motor comprises using said electric motor supported from the mounting component.

8. A method for mounting a rotatable reflector antenna having a main reflector with outermost edges and a vertex, a subreflector mounted forward of the main reflector and a feed horn mounted at the vertex, so as to reduce a radius of a swept arc of said main reflector as said main reflector is rotated about an azimuth axis of rotation, said method comprising:

supporting said main reflector on a mounting component;

rotating said mounting component about said azimuth axis of rotation; and locating said azimuth axis of rotation in between said subreflector and said vertex of said main reflector.

9. The method of claim 8, wherein supporting said main reflector comprises mounting said main reflector on a mounting platform having a rotary coaxial joint.

10. The method of claim 8, wherein rotating said mounting component comprises using an electric motor to rotate said mounting component.

11. The method of claim 10, wherein using said electric motor comprises using said electric motor supported from the mounting component.

12. An antenna system adapted to be rotated about an azimuth axis of rotation so as to reduce the radius of an envelope within which said antenna moves during rotation of said antenna, said antenna system comprising:

a dish shaped main reflector having a vertex and an outermost edge defining an aperture of the antenna;

a subreflector disposed forward of said vertex and rearward of said outermost edge of said main reflector;

a feed horn facing said subreflector, said feed horn being disposed rearward of said outermost edge of said main reflector; and wherein said reflector is rotatable about an azimuth axis of rotation, said azimuth axis of rotation extending in between said subreflector and said feed horn.

13. The antenna system of claim 12, further comprising a support platform for supporting said main reflector.

14. The antenna system of claim 13, further comprising an electric motor mounted on said support platform for rotating said support platform.

15. The antenna system of claim 12, wherein said subreflector and said feed horn are both supported from said main reflector.

16. The antenna system of claim 12, further comprising a rotary coaxial joint for establishing electrical communication between said feed horn and an external transmission cable.

17. The antenna system of claim 12, further comprising an electric motor for rotating said main reflector.

18. An antenna system adapted to be rotated about an azimuth axis of rotation so as to reduce the radius of an envelope within which said antenna moves during rotation of said antenna, said antenna system comprising:

a dish shaped main reflector having a vertex and an outermost edge defining an aperture of the antenna;

a subreflector disposed forward of said vertex and rearward of said outermost edge of said main reflector;

a feed horn facing said subreflector, said feed horn being disposed rearward of said outermost edge of said main reflector and forward of said subreflector; and wherein said reflector is rotatable about an azimuth axis of rotation, said azimuth axis of rotation extending in between said vertex of said main reflector and said subreflector.

19. The antenna system of claim 18, further comprising a support platform for supporting said main reflector.

20. The antenna system of claim 19, further comprising an electric motor mounted on said support platform for rotating said support platform.

21. The antenna system of claim 18, wherein said subreflector and said feed horn are both supported from said main reflector.

22. The antenna system of claim 18, further comprising a rotary coaxial joint for establishing electrical communication between said feed horn and an external transmission cable.

23. The antenna system of claim 18, further comprising an electric motor for rotating said main reflector.

24. An antenna system adapted to be rotated about an azimuth axis of rotation so as to reduce the radius of an envelope within which said antenna moves during rotation of said antenna, said antenna system comprising:

a dish shaped main reflector having a vertex and an outermost edge defining an aperture of the antenna;

a subreflector disposed forward of said vertex and rearward of said outermost edge of said main reflector;

a feed horn facing said subreflector, said feed horn being disposed rearward of said outermost edge of said main reflector;

a mounting component for supporting said main reflector; and wherein said reflector is rotatable about an azimuth axis of rotation, said azimuth axis of rotation extending in between said vertex of said main reflector and said outmost edge.

25. The antenna system of claim 24, further comprising an electric motor for rotating said mounting component.

26. The antenna system of claim 25, wherein said electric motor is supported on said mounting component.

27. The antenna system of claim 24, further comprising a rotary coaxial joint operably associated with said mounting component for electrically coupling said feed horn with an external transmission cable.

* * * * *